US009233290B2

(12) United States Patent
Woody

(10) Patent No.: US 9,233,290 B2
(45) Date of Patent: Jan. 12, 2016

(54) WRIST TRAINING DEVICE FOR A GOLF SWING AND PUTTING STROKE

(71) Applicant: Gilmer Darrell Woody, Iowa City, IA (US)

(72) Inventor: Gilmer Darrell Woody, Iowa City, IA (US)

( * ) Notice: Subject to any disclaimer, the term of this patent is extended or adjusted under 35 U.S.C. 154(b) by 93 days.

(21) Appl. No.: 13/972,368

(22) Filed: Aug. 21, 2013

(65) Prior Publication Data

US 2014/0221114 A1 Aug. 7, 2014

Related U.S. Application Data

(60) Provisional application No. 61/761,952, filed on Feb. 7, 2013.

(51) Int. Cl.
*A63B 69/36* (2006.01)
*A63B 69/00* (2006.01)

(52) U.S. Cl.
CPC ..... *A63B 69/0059* (2013.01); *A63B 2209/10* (2013.01)

(58) Field of Classification Search
USPC ..... 473/61, 62, 212, 213; 2/159, 160, 2/161.2, 161.4, 162
See application file for complete search history.

(56) References Cited

U.S. PATENT DOCUMENTS

| | | | | | |
|---|---|---|---|---|---|
| 3,606,342 | A * | 9/1971 | Albertson, Jr. | 473/62 |
| 3,865,383 | A * | 2/1975 | Clay et al. | 473/213 |
| 4,014,327 | A * | 3/1977 | Spiro | 602/62 |
| 4,057,255 | A | 11/1977 | Bishop | |
| 5,108,103 | A | 4/1992 | Rilling | |
| 5,207,430 | A * | 5/1993 | Goins | 473/213 |
| 5,401,017 | A * | 3/1995 | McDonald et al. | 473/213 |
| 5,797,803 | A * | 8/1998 | Jung | 473/213 |
| 5,823,886 | A | 10/1998 | Murray | |
| 5,895,326 | A | 4/1999 | Cozza | |
| 6,061,833 | A * | 5/2000 | Smith et al. | 2/162 |
| 7,220,188 | B2 * | 5/2007 | Lee | 473/205 |
| 2012/0289352 | A1 * | 11/2012 | Yakeley | 473/213 |

* cited by examiner

*Primary Examiner* — Nini Legesse
(74) *Attorney, Agent, or Firm* — Daniel Boudwin, Esq.; Global Intellectual Property Agency LLC.

(57) ABSTRACT

A golf swing and putting stroke training device is provided that comprises a forearm connection strap, a pivoting member, and a connection means adapted to secure to a golfing glove closure strap. The device firmly secures to the forearm of the forward arm of a golfer, wherefrom a first member is supported therefrom extending toward the user's wrist. A second member is pivotably attached to the distal end of the first member and connects to the user's golfing glove along the top of the user's upper hand. The pivot joint therebetween allows for rotation of the second member in single plane and thus limits the user's wrist to single degree of freedom. Wrist movement is limited during a full swing to radial and ulnar deviation only, while the device is adapted to remain attached while putting to prevent wrist flexion or extension (e.g. wrist "breaking") during a putting stroke.

5 Claims, 5 Drawing Sheets

WRIST TRAINING DEVICE FOR A GOLF SWING AND PUTTING STROKE

CROSS REFERENCE TO RELATED APPLICATION

This application claims the benefit of U.S. Provisional Application No. 61/761,952 filed on Feb. 7, 2013, entitled "Wrist Cock Swing & Putting Trainer." The above identified patent application is herein incorporated by reference in its entirety to provide continuity of disclosure.

BACKGROUND OF THE INVENTION

1. Field of the Invention

The present invention relates to golf accessories and teaching tools. More specifically, the present invention pertains to a new and novel golf training device that controls the motion of a golfer's wrist during a back swing and during a putting motion and prevents cupping.

In order to make proper contact with a golf ball during a full golf swing, a golfer has to control many aspects of his or her body throughout the swing motion and follow through. Proper alignment and body control ensure the ball will be struck correctly and given a desired trajectory down range. Improper swinging motions or body control lead to miss-hits, poor accuracy, and poor range, which can be detrimental to a golfer's score and cause frustration.

One particular motion during a golf swing is the rotation of the golfer's wrists during the backstroke ("wrist cock") and follow-through during the swing. During a full swing, the golfer generally has his hands on the golf club in a slightly overlapping configuration, where his forward hand is higher on the golf club than his trailing hand. While a majority of the power during the swing is developed by way of the backswing arc and weight shifting, considerably more power is developed if the golfer can cock his or her wrists backward at the top of the swing arc. This causes the club head to travel an additional arc length and generates more energy prior to ball impact.

Along with added power to one's swing, proper wrist control is important for accuracy of the golf swing and influences the club face position during the swing. Improper club face orientation upon impact can cause off-angle strikes, pull swings, and slices. Therefore, controlled wrist movement and proper wrist action during the swing can greatly improve a golfer's game by generated more power and reducing accuracy issues.

Once on the putting green, wrist control comes into play once again during the putting stroke. The putting stroke is a shorter, more controlled movement that is best completed without any wrist movement. Wrist movement, or wrist "breaking", during the putting back stroke and follow through actually reduces accuracy during the stroke, as the user has less control of the speed and orientation of the putter club face. Therefore, static wrist position is desired in this aspect of the game.

The present invention describes a teaching tool and golfing assistant that is adapted to teach proper wrist control during a full golf swing and a putting stroke. The device is adapted for use during both a full swing and a putting stroke without changes to the device operation. The device attaches around the forearm of the golfer's leading arm, wherefrom a hinged member secures to the upper portion of the golfer's glove by way of the glove strap connection means. The hinged member is adapted to have a single degree of freedom, whereby only radial and ulnar deviation of the wrist is allowed. Based on the connection to the forearm, wrist flexion or extension is resisted. When deployed during a full swing, the golfer wrists are taught to cock in the correct plane to increase power during the back stroke and not to cup the wrists. When deployed during a putting stroke, the user's forward wrist is prevented from "breaking" or flexing backward and forward during the putting motion. In this way, a single device is provided as a full swing and putting stroke teaching tool, whereby the tool can be deployed for practice or during a match, and likewise for beginner golfers and more seasoned players.

2. Description of the Prior Art

Devices have been disclosed in the prior art that relate to wrist training devices and aids for teaching proper wrist movement during a full back swing. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 5,401,017 to McDonald, which discloses a golf swing training aid that controls bending of the user's wrist when donned. The device includes a housing that is secured to the forearm of the user and a hand member attached thereto that is adapted to receive the user's palm, fingers, and thumb. A sliding latch in the housing slidably secures a bowed connector element that secures the forearm housing to the hand member. The bowed connector restrains relative movement between the forearm housing the hand member during use. While providing a training aid adapted to control wrist motion, the McDonald device differs in structure elements, operation, and deployment. The present invention contemplates a device that limits wrist rotation to a single plane and functions in conjunction with a common golfing glove.

Another device is U.S. Pat. No. 5,108,103 to Rilling, which discloses an electrical device for monitoring bodily movement of a golfer during a golf swing, wherein feedback is given to the user by way of an audio speaker signaling means. The device comprises a housing having a moveable element shiftably disposed within the housing, wherein the moveable element includes a magnet portion that is capable of actuating a relay switch to activate the audio speaker. The Rilling device, while providing feedback to the user during a swing, is an electrical device that provides audible feedback. The present invention describes a wrist control teaching device that gives tactile feedback and prevents errand wrist movement (e.g. wrist cupping) during the back stroke, and teaches proper wrist cocking technique.

Similar to the Rilling device is U.S. Pat. No. 5,895,326 to Cozza, which discloses a forearm mounted wrist position training device that produces and audible beep if the golfer's wrist cups beyond a predefined limit. A housing supported on the forearm of the user supports an extended sensor pad positioned along the outer surface of the golfer's hand. If the pad is depressed and hinges from the housing beyond a given limit, the beep is energized and the user is alerted of excessive wrist cupping during the swing. The present invention contemplates a structure that facilitates correct movement in a given rotational plane, while preventing cupping rotation of the wrist (wrist flexion or extension) during the swing. No electrical features are contemplated.

U.S. Pat. No. 4,057,255 to Bishop discloses a golf aid that is adapted to teach proper control of vertical movement of a golfer's wrist during a down swing such that they assume an appropriate address position just prior to impact. The device comprises a glove having an inelastic tie member connecting the golfer's thumb to the wrist portion over the top of the thumb. During the back swing, the wrist is free to cock, thereby relieving tension on the tie member, whereafter the tie member is tensioned during the down stroke to a proper address position and club face orientation prior to impact. While disclosing a physical aid that assists in proper wrist cocking, the Bishop device structure and method of teaching the wrists differs substantially from the present invention.

U.S. Pat. No. 5,797,803 to Jung discloses a wrist fixing band for a golf swing that includes a prop member positioned along the back of the user's hand for preventing cupping movement thereagainst. The prop member is attached to a fixing means positioned around the user's arm, whereby the prop member is pinned thereto. The Jung device resists cupping and is attached to the forearm of a user, however the device fails to contemplate incorporation into an existing golf glove. Securement of the present invention on the top of the user's hand by way of a golf glove strap is paramount for providing feedback to the user when cocking the wrist along the appropriate plane in a backswing. The Jun device fails to prevent wrist flexion and only restricts wrist extension during the swing.

The present invention is designed for use during a full swing and a putting stroke, whereby the user's wrist is constrained to cock in the correct plane and not break during a putting stroke. The device includes a forearm connection strap to the user that supports a first member, a pivoting member that is positioned over the upper surface of the user's hand, and a pinned connection means between the strap first member and pivoting member that constrains movement to rotation within a single plane. The plane is aligned with wrist radial and ulnar deviation only, which is the plane utilized to cock the wrist during a back swing. During a putting stroke, the forward wrist is prevented from "breaking" to ensure proper putting stroke motion. Overall, the wrist constraints are achieved through a connection between the pivoting member and the golf glove.

It is submitted that the present invention is divergent in design elements from the prior art, and consequently it is clear that there is a need in the art for an improvement to existing golf training devices. In this regard the instant invention substantially fulfills these needs.

SUMMARY OF THE INVENTION

In view of the foregoing disadvantages inherent in the known types of golf training devices now present in the prior art, the present invention provides a new wrist locking device adapted to teach proper wrist cocking technique and locked putting technique, which can be utilized for providing convenience for the user during full golf swings and putting strokes.

It is therefore an object of the present invention to provide a new and improved golf training device that has all of the advantages of the prior art and none of the disadvantages.

It is another object of the present invention to provide a golf training device that is adapted to secure the wrist of the golfer's along his upper hand on the grip, whereby proper wrist cock is taught and wrist cupping is resisted.

Another object of the present invention is to provide a golf training device that is secured to a user's forearm at one end and to the top of a user's golf glove at a second end, whereby the device is secured at both ends to the user to prevent out-of-plane movement or rotation.

Yet another object of the present invention is to provide a golf training device that includes a pivotable member that rotates in plane defined by wrist radial and ulnar deviation, while at the same time resisting both wrist flexion or extension.

Another object of the present invention is to provide a golf training device that is adapted for use during a full golf swing or during a putting stroke, wherein the device can remain attached to the user for both swing types without changing or replacing any elements.

Another object of the present invention is to provide a golf training device that is adapted for both beginner use and for seasoned golfer use, whereby the device teaches proper wrist cock and can act as a teaching tool or an assistant for one who many have wrist strength issues that lead to uncontrolled wrist cupping or breaking during a swing.

A final object of the present invention is to provide a golf training device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
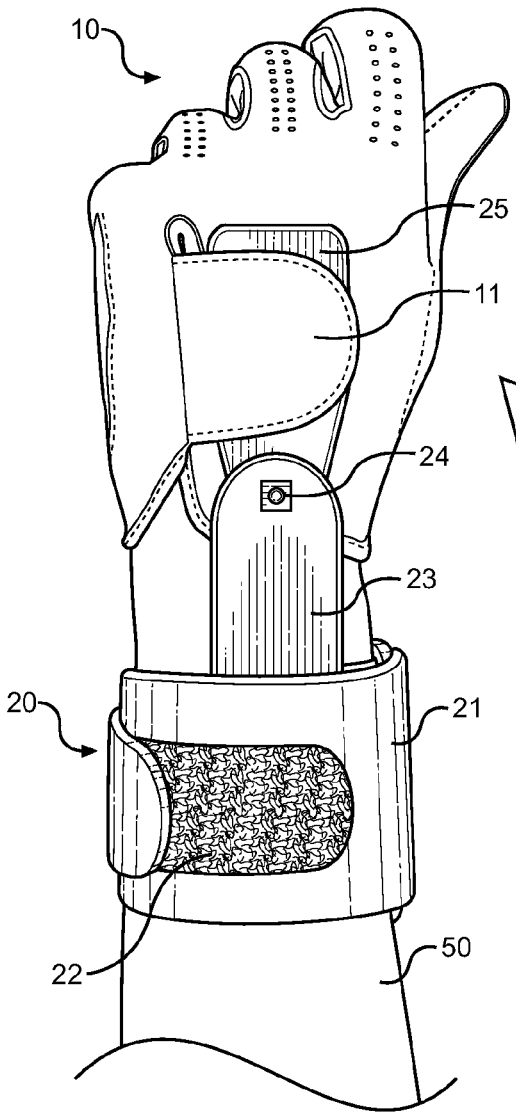
FIG. 1 shows the golf training device of the present invention in a working position, applied to a user's forearm and golf glove.

Reference is made herein to the attached drawings. Like reference numerals are used throughout the drawings to depict like or similar elements of the golf training device. For the purposes of presenting a brief and clear description of the present invention, the preferred embodiment will be discussed as used for teaching proper wrist cocking during a full swing and proper locked wrist configuration during a putting stroke. The figures are intended for representative purposes only and should not be considered to be limiting in any respect.

Figure 2:
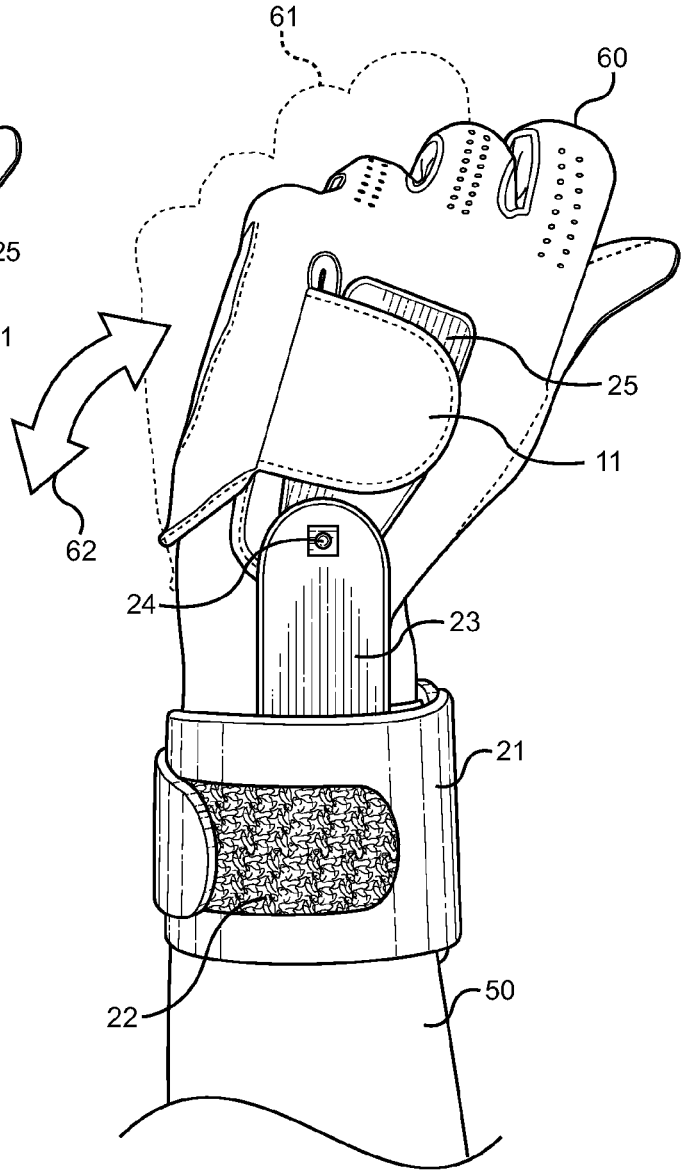
FIG. 2 shows the golf training device degree of freedom when deployed on a user.

Referring now to FIGS. 1 and 2, there are shown views of the golf training device 20 of the present invention in a working position, attached over the wrist of the user's upper swing hand. The device 20 comprises a forearm strap 21 having a first and second end and a strap attachment means 22 adapted to secure the strap 21 in closed loop configuration about the user's forearm 50. The strap 21 supports a first member 23 extending thereaway from and towards the user's wrist. The first member 23 is statically positioned along the user's forearm 50 and to the forearm strap 21. A second member 25 is pivotably attached to the first member 23 and is adapted to pivot in a single plane with respect to the first member 23. A pin joint 24 secures the first 23 and second 25 member together, whereby the second member 25 is constrained to a single rotational degree of freedom.

The second member 25 is adapted to extend over the user's outer hand surface and over the user's golfing glove 10. Disposed on both sides of the second member 25 is a golf glove strap attachment means, whereby the strap 11 of the golf glove can secure the second member 25 to the user's glove 10 during a swinging motion. The glove strap 11 sandwiches the second member 25 against the glove outer surface.

Referring specifically to FIG. 2, the constrained degree of freedom of the user's wrist is shown when the training device 20 of the present invention is deployed. When in use, movement of the user's wrist is limited during a full golf swing to radial and ulnar deviation 62 only, whereby the wrist can rotate along a plane that is parallel to the surfaces of the first 23 and second 25 member and movement out of plane is restricted. This in-plane motion is the proper wrist cocking movement during a full golf back swing, which adds to the power of the swing. As illustrated in FIG. 2, the hand is cocked 60 from its original state 61 by in-plane deviation 62 only.

Along with teaching proper in-plane deviation 62, the user's is taught what motion not to engage in by the limited degrees of freedom provided by the device 20. Specifically, the user's wrist is prevented from wrist flexion or extension during the swing. This type of movement is an out of plane movement that is known as wrist "cupping" during a full stroke, and wrist "breaking" during a putting stroke. Both of these movements are counterproductive during the swing, reducing accuracy, power, and control of the club face. The second member 25 bears against the top of the user's hand to prevent this type of motion, while the pin joint 24 facilitates rotation in the proper plane. In this way, the user is trained for proper full swing motion and proper putting stroke motion, whereby the device 20 can be maintained on the user during both golf movements without changing the device 20 in any way.

Figure 3:
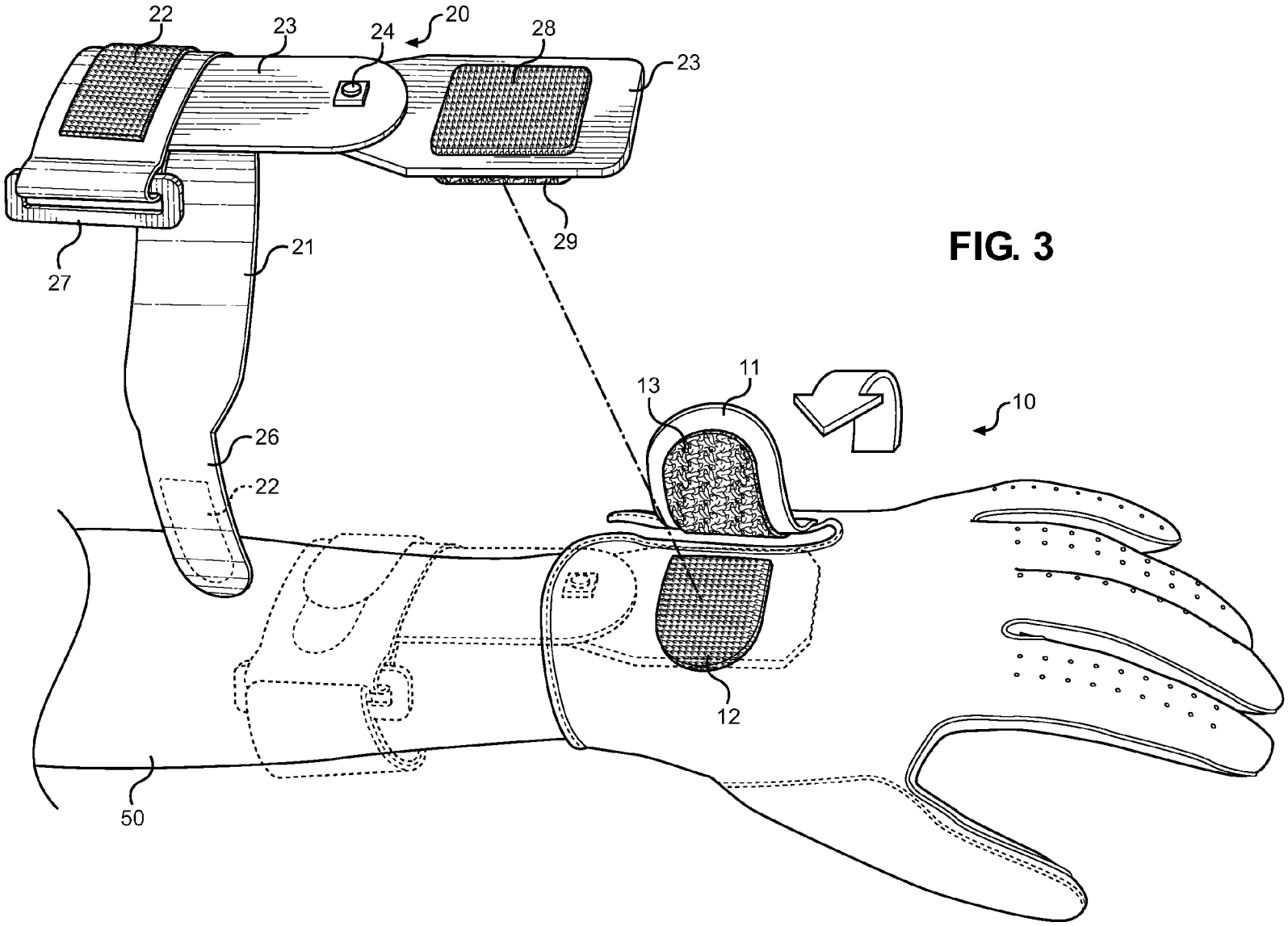
FIG. 3 shows the golf training device being applied to a user, whereby a forearm strap and golf glove attachment means is provided.

Referring now to FIG. 3, there is shown a view of the golf training device 20 of the present invention being applied to the forearm 50 and glove 10 of a user. The forearm connection strap 21 of the device 20 comprises a first end 27 and a second end 26 that are adapted to provide tensioned attachment about the perimeter of the user's forearm 50. The first end 27 preferably includes a strap loop connector that accepts through the second end 26, which then doubles back onto itself and attaches along the length of said strap 21 by way of a strap attachment means 22. The attachment means 22 preferably includes a patch of hook and loop fasteners, whereby one portion of the strap near the first end 27 includes loop fasteners and the second end 26 includes hook fasteners. However, the exact means of attachment for the strap may be provided in a number of configurations, including a unitary loop having inhere elastic (no disconnected ends), or a strap having ends that attach with another strap attachment means that is well understood in the art.

Extending from and statically connected to the forearm connection strap 21 is the device first member 23, which pivotably 24 connects to the second member 23. The second member is adapted to be sandwiched between the golf glove attachment strap 11 and the backside of the user's glove 10. In order to achieve this connection, the second member 23 includes an upper surface connection means 28 and a lower surface attachment means 29. These attachment means 22, 29 are adapted to connect to the corresponding glove strap attachment means 12, 13 of the user's glove. Generally this attachment means is a patch of hook 12 and loop 13 fasteners, whereby the upper 28 and lower 29 surface attachment means are adapted to correspond with these two materials to achieve a secure connection therewith. It is contemplated that the second member 23 of the device 20 may be flipped to accommodate the correct hook/loop fastener orientation with respect to the design of the glove. This flipping can be accomplished by disconnecting the pin joint 24, by disconnecting the first member 23 from the strap 21, or by simply flipping the strap 21 and thus the entire device 20. The design can be modified to accommodate one or any of these configurations.

Figure 4:
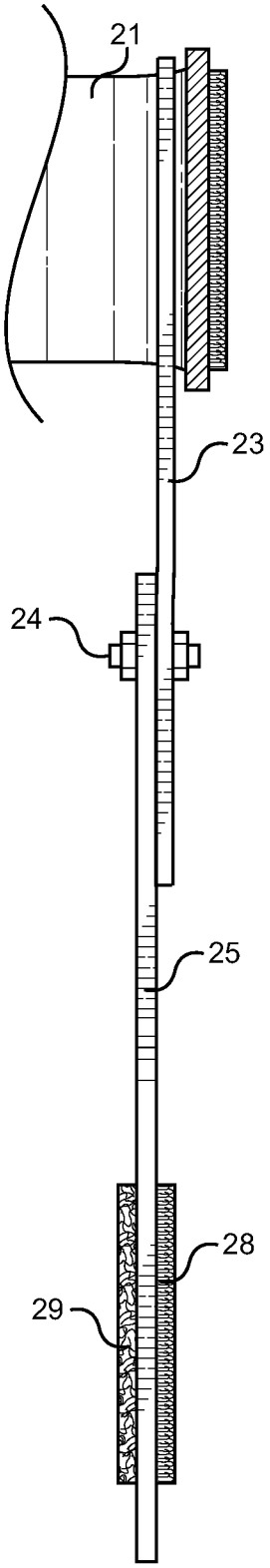
FIG. 4 shows a side view of the present invention and the pin joint.

Referring now to FIG. 4, there is shown a side view of the golf training device 20 of the present invention. As illustrated, the first member 23 pivotably connects to the second member 25 by way of a pin joint 24, which affords the second member 25 in-plane rotation. The pin joint 24 restricts the movement of the second member 25 when the user's hand bears against its lower surface 29, thereby constraining out-of-plane motion thereof and thus restraining wrist cupping or breaking. Both the first 23 and second 25 member are planar structures having an upper and lower surface and a small thickness, whereby the pin joint 24 allows the two planar surfaces to rotate relative to one another. When applied, the connection means of the second member 25 connect to the golfing glove of the user by way of the upper 28 and lower 29 surface connectors. Finally, the first member strap 21 is statically connected to the device first member 23 to secure the first member to the user's forearm and prevent movement thereof during use. Bending at the connection is counteracted by the strap, which is tensioned around the user's forearm.

Figure 5:
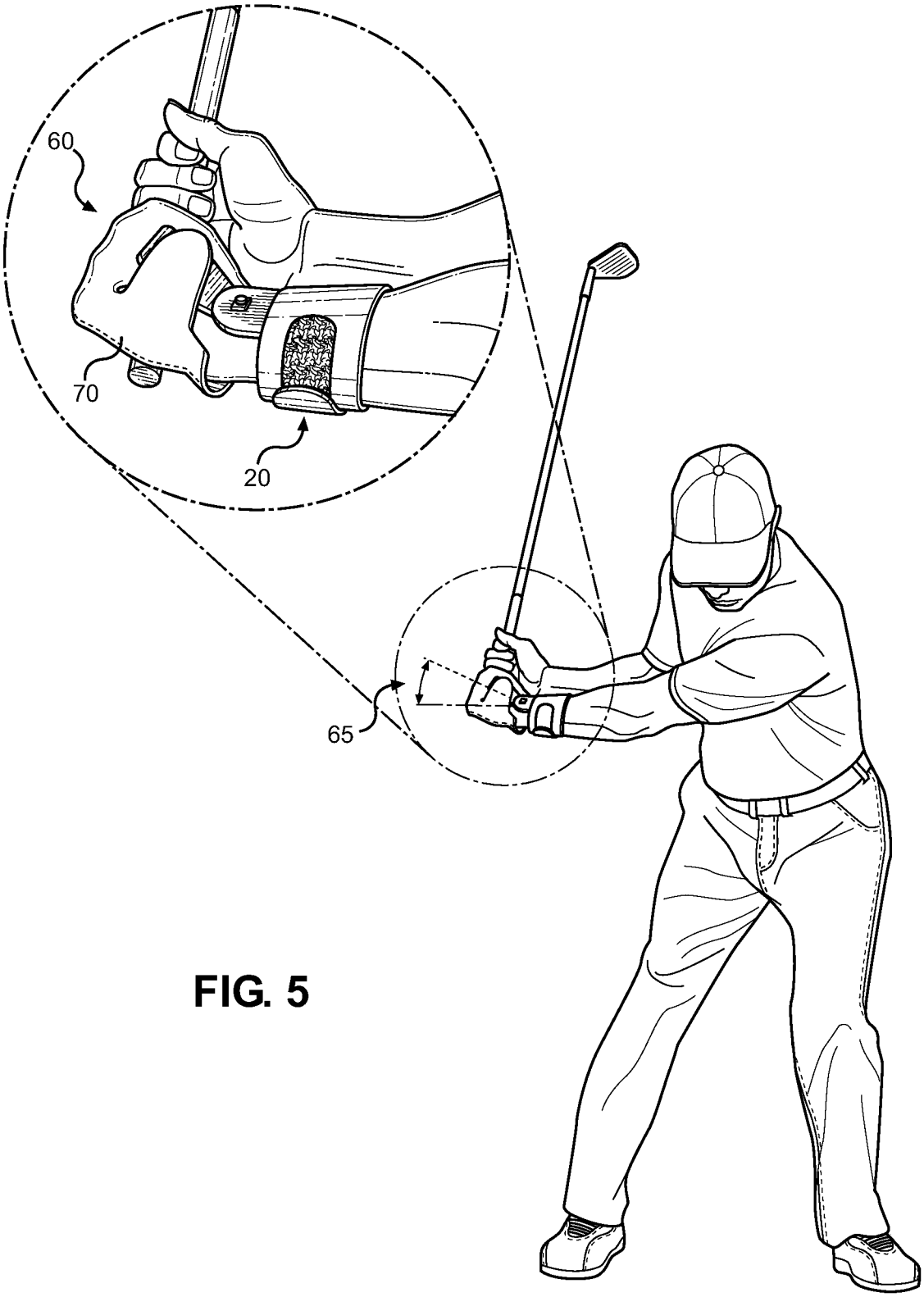
FIG. 5 shows the golf training device in operation during a full golf swing, whereby the user is properly cocking his wrist in the back swing.
Figure 6:
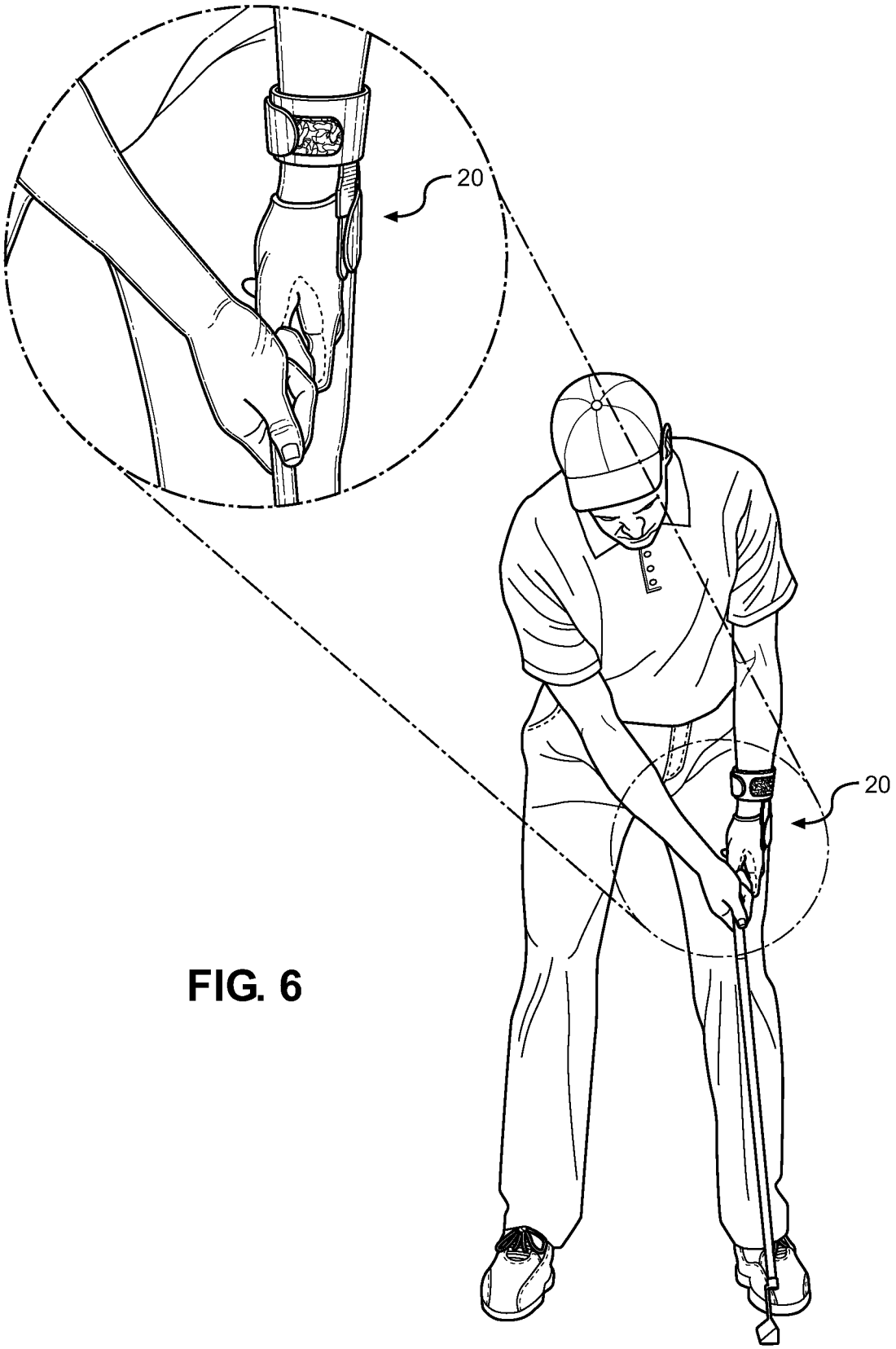
FIG. 6 shows the golf training device in operation during a putting stroke, whereby wrist breaking is resisted.

Referring now to FIGS. 5 and 6, there are shown views of the present invention in use during a full golf swing and a putting stroke, respectively. During a full swing, the user's top hand 70 is in a cocked 60 position to increase the arc length and travel of the club head, and therefore increase power. The golf training device 20 of the present invention prevents wrist cupping, which is wrist flexion or extension during the back swing. During the return swing, the user rotates 65 his wrists from a cocked position 60 and to a natural position to align the club face with the ball just prior to impact.

During the putting stroke and as visualized in FIG. 6, the user's wrists remain in a static configuration throughout the stroke, including the back stroke and follow through motion. The golf training device 20 of the present invention prevents wrist breaking during this motion, whereby the device second member bears against the user's hand or restrains the hand if the user rotates the wrist in an out of plane direction. In this way, the user's wrists will not "break" during the putting stroke motion, ensuring maintained control over the putter through the stroke motion.

Proper swing form when playing golf is important. Moreover wrist movement, particularly radial and ulnar deviation during a backswing, can provide golfers with more power when hitting the ball. It can be difficult, however, for golfers to consistently complete this wrist motion properly. Golfers may not be maximizing their full strength without any way to practice this motion. The present invention discloses a new and novel golf training device that is adapted to control a golfer's wrist during a full swing and putting stroke, and further to teach proper technique during these golf movements. The device comprises a forearm connection strap and a pivoting second member that is attached to a conventional golf glove via its closure strap. In use the device forces a golfer to cock his or her wrist during the backswing and prevents out of plane motion. The device corrects the improper habit of cupping the wrist on the backswing motion and improves the wrist cock tension during the swing motion. In addition, during the putt motion, the device prevents a user from breaking form once impact is made with his or her ball. It is contemplated that the present invention is well suited for golfers of all talent levels, from beginners to professionals.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf training device, comprising:

a forearm strap adapted to form a closed loop around the forearm of a user;

a first member extending from said forearm strap and substantially along the forearm of the user;

a second member pivotably connected to said first member by a pin joint, wherein said second member can freely rotate substantially in-plane about said pin joint;

said second member having an upper surface and a lower surface;

the second member being removably attachable to a golf glove, whereby said second member is adapted to be positioned between a golf glove strap of the golf glove, and the back of the golf glove;

said upper surface and said lower surface of said second member each having glove strap attachment device adapted to correspond with and removably affixed to said glove strap and said back of said golf glove;

wherein the glove strap attachment device along the lower surface removably secures the second member to the back of the golf glove, and the glove strap attachment device along the upper surface secures the second member to the golf glove strap, when the second member is positioned between the golf glove strap and the back of the golf glove.

2. The device of claim 1, wherein said forearm strap further comprises:

a first and second strap end;

said first strap end comprising a strap loop connector that accepts through said second strap end;

said second strap end further comprising a strap attachment means adapted to secure to corresponding attachment means along the length of said strap after being passed through said strap loop connector and doubled back onto itself.

3. The device of claim 1, wherein said forearm strap further comprises:

a first and second strap end;

said second strap end further comprising a strap attachment means adapted to secure to corresponding attachment means along the length of said strap.

4. The device of claim 1, wherein said first and second member are operably separable at said pin joint.

5. The device of claim 1, wherein said first member is operably separable from said forearm strap.

* * * * *